US005480317A

United States Patent [19]

Herzog

[11] Patent Number: 5,480,317

[45] Date of Patent: Jan. 2, 1996

[54] SOCKET FOR RECEIVING A THREADED MEMBER WHICH PREVENTS CROSS-THREADING

[75] Inventor: Richard R. Herzog, Arlington Heights, Ill.

[73] Assignee: Illinois Tool Works Inc., Glenview, Ill.

[21] Appl. No.: 220,809

[22] Filed: Mar. 31, 1994

[51] Int. Cl.[6] ..... H01R 4/50

[52] U.S. Cl. ..... 439/340; 439/558

[58] Field of Search ..... 439/339, 340, 439/356, 360, 558, 699, 665, 669, 613

[56] References Cited

U.S. PATENT DOCUMENTS

| | | | |
|---|---|---|---|
| 771,916 | 10/1904 | Moffitt | 439/665 |
| 1,042,406 | 10/1912 | Despard | 439/541 |
| 1,047,353 | 12/1912 | Weissmann | 439/541 |
| 4,441,782 | 4/1984 | Kneer | 439/340 |
| 5,176,532 | 1/1993 | Herzog et al. | 439/340 |
| 5,241,746 | 9/1993 | Herzog et al. | 29/882 |

*Primary Examiner*—Gary F. Paumen
*Assistant Examiner*—Hien D. Vu
*Attorney, Agent, or Firm*—Schwartz & Weinrieb

[57] ABSTRACT

A socket for receiving a threaded article therein for complementary threaded engagement between the article and the socket. The socket includes one or more sets of threads integrally formed upon an interior side wall of the socket wherein at least one thread of the set has a length shorter than the remaining threads so as to prevent cross-threading.

15 Claims, 1 Drawing Sheet

SOCKET FOR RECEIVING A THREADED MEMBER WHICH PREVENTS CROSS-THREADING

FIELD OF THE INVENTION

This invention relates generally to sockets for receiving another article therein, and more particularly to a socket for receiving a threaded article, such as a light bulb, wherein the socket is configured to prevent cross-threading of the light bulb during assembly.

BACKGROUND OF THE INVENTION

In order to physically and electrically connect a light bulb to another article, such as a lamp, appliance or other article, one end of the light bulb typically includes a "lamp cap" connected to the bulb which includes exterior threads about its periphery. The lamp or appliance includes a threaded socket for complementary threaded engagement with the lamp cap and electrical contacts for providing electricity to the light bulb and illuminating the bulb when desired. An example of such a socket is illustrated in U.S. Pat. No. 5,176,532 which is assigned to the assignee of the present invention.

In order to ensure that a new or replacement bulb will fit a desired socket, thread standards have been developed for the bulb and socket. The threads utilized are relatively large and few in number to enable ease of assembly and manufacture.

Upon installing bulbs within sockets, however, care must be taken to ensure that the bulb is properly threaded and seated within the socket so that electrical contact is established. The large and few threads specified by the standard, however, promote cross-threading where the bulb appears properly secured within the socket but electrical contact is not properly established.

This can be a particular problem in the manufacture and assembly of appliances, such as refrigerators, freezers and similar household devices which require a light bulb. Such light bulbs are typically manually threaded into sockets secured to the appliance which is moving along an assembly line. Due to the speed of the assembly line, cross-threading of light bulbs can be a problem and is typically not discovered until later in the inspection process requiring further assembly time to remove and properly reinstall the bulb within the socket.

It therefore would be desirable to provide a socket for receiving a bulb therein which is designed to prevent cross-threading of the bulb and socket regardless of the orientation of the bulb and its threads.

SUMMARY OF THE INVENTION

The invention provides a socket for receiving a threaded article therein for complementary threaded engagement between the article and the socket. The socket includes a first set of threads integrally formed upon a first portion of an interior side wall of the socket where at least one thread of the first set of threads has a length shorter than the remaining threads. The socket also includes at least one engagement member integrally formed with a second portion of the interior side wall of the socket for cooperative engagement with the article threads in conjunction with the first set of threads.

Accordingly, upon engagement of the article within the socket, cross-threading of the article and socket is eliminated due to the cooperation of a lead thread of the article and the shorter length thread of the socket.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DESCRIPTION OF THE PREFERRED EMBODIMENTS

Figure 1:
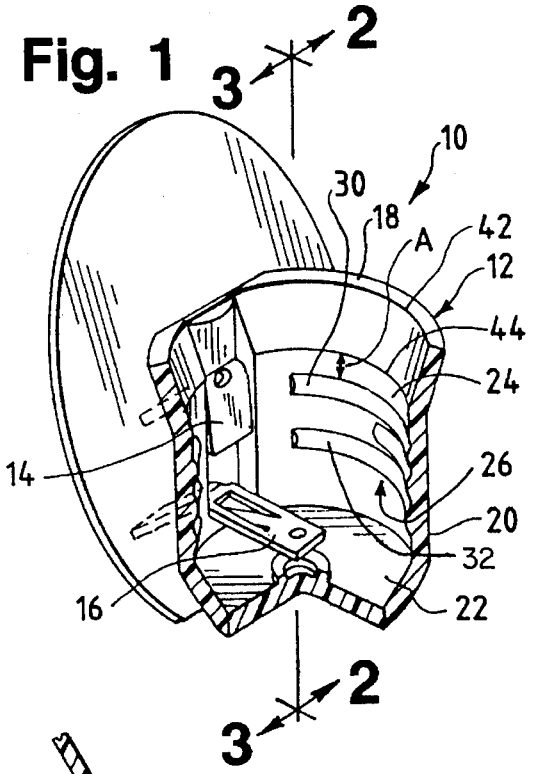
FIG. 1 is a perspective view, in partial section, of a socket illustrating the thread configuration of the present invention.

Referring to FIG. 1, the light socket of the invention is designated generally by the reference numeral 10. The socket 10 preferably includes only three separate parts: a housing 12, a top electrical contact member 14 and a bottom electrical contact member 16.

The housing 12 is generally cylindrical in shape having a first open top end 18 and a second bottom end 20 closed by means of a bottom wall 22. The housing 12 is preferably utilized for engagement within an aperture of a panel (not illustrated). It is to be understood, however, that the socket 10 can be utilized with or without a panel.

The housing 12 is preferably a one-piece plastic housing formed by injection molding with a collapsible or noncollapsible mold core (not illustrated). To assist in inserting a light bulb (not illustrated) within the housing 12, the top end 18 can be flared outward.

Figure 3:
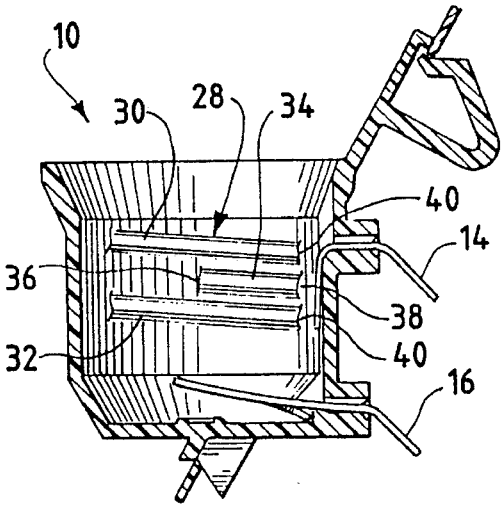
FIG. 3 is a cross-sectional view of the socket taken along line 3—3 of FIG. 1 in the direction indicated.

To threadingly engage the threads of the light bulb within the housing 12, an interior wall 24 of the housing 12 includes a first set of axially spaced, circumferentially extending threads 26 integrally formed therewith that are referred to as the lead threads. Preferably, as FIG. 3 illustrates, the housing 12 also includes a second set of axially spaced, circumferentially extending threads 28 formed on an opposite side thereof that are referred to as the trailing threads. It is to be noted that the second set of threads 28 can be in the form of a plurality of protuberances or any other type of engagement member so long as they cooperate to assist in threading the light bulb and prevent cross-threading as described herein.

Figure 2:
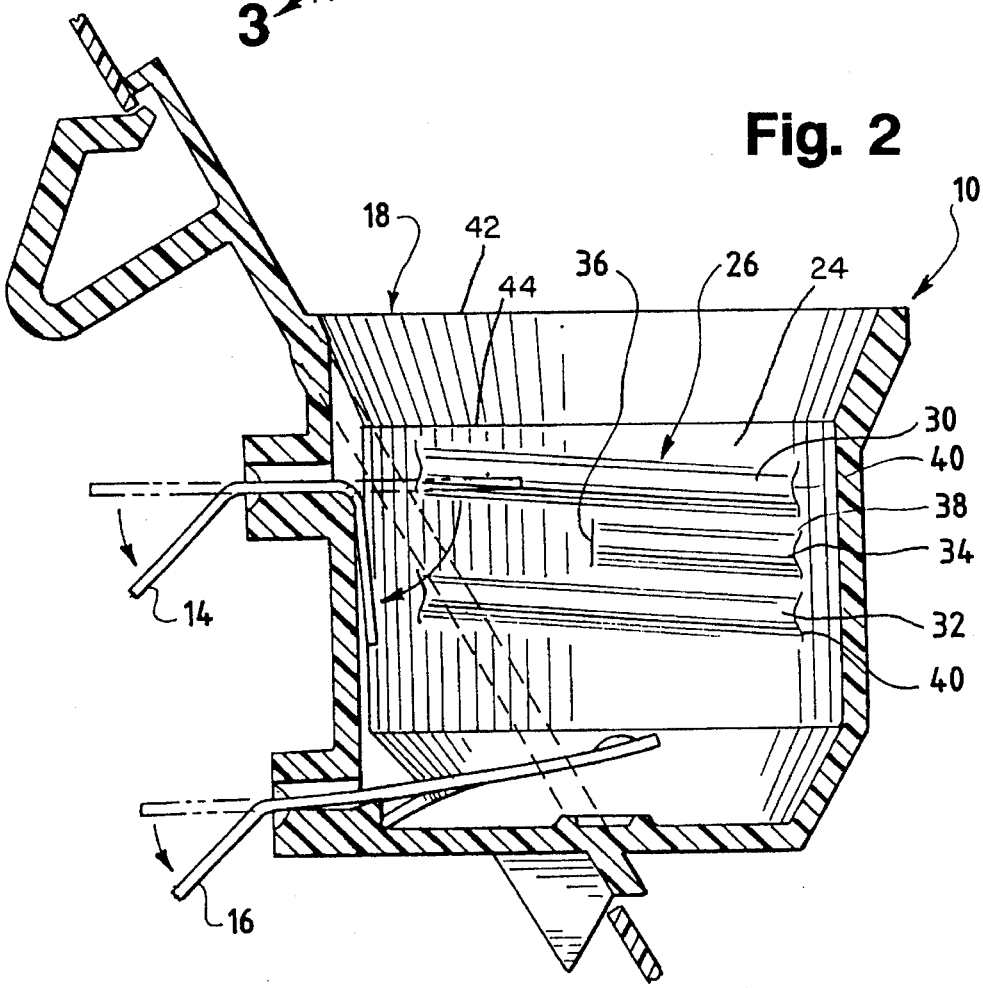
FIG. 2 is an enlarged cross-sectional view of the socket taken along line 2—2 of FIG. 1 in the direction indicated.

As FIGS. 2 and 3 illustrate, each set of threads 26 and 28 preferably includes a first top thread 30 disposed within a first substantially radially extending plane, a second bottom thread 32 disposed within a second substantially radially extending plane axially spaced from the first plane within which thread 30 is disposed, and a third intermediate thread 34 disposed within a third substantially radially extending plane which is positioned between the planes within which the first and second threads 30 and 32 are disposed. It is to be understood, however, that the invention is not to be limited to the number of threads sets or the number of threads utilized per set so long as they function as described herein.

In order to readily engage the threads of the light bulb, the threads in each of the first and second sets 26 and 28 are preferably substantially large or coarse and include seven threads per inch. The number of threads per inch, as well as the major and minor diameters of the threads can vary.

In order to prevent cross-threading of the light bulb threads with the first and second sets of threads 26 and 28, the third intermediate thread 34 of each set is formed with a circumferential or arcuate length which is shorter than the remaining first and second threads 30 and 32. In the preferred form of the invention, the length of the circumferential or arcuate intermediate thread 34 is selected to be approximately one half the circumferential or arcuate length of the first and second threads 30 and 32.

It is to be noted that the preferred one half circumferential or arcuate length of the third intermediate thread 34 with respect to the remaining threads has been established through testing to prevent cross-threading. The specific circumferential or arcuate length of the thread 34, however, can vary within a limited range estimated to be within +/−10%. The invention is not to be limited to the specific circumferential or arcuate length of the third intermediate thread 34 so long as the third intermediate thread 34 functions as described herein.

A leading edge 36 of each third intermediate thread 34 is preferably positioned proximate the midpoint of the first and second threads 30 and 32. Consequently, a trailing edge 38 of each third intermediate thread 34 is preferably positioned proximate a trailing edge 40 of each of the first and second threads 30 and 32.

Cross-threading results in existing sockets having threads of the same length primarily due to the interaction between the lead thread of a standard lamp cap of a light bulb and the minor diameter of the socket. Specifically, the lead thread of the lamp cap tends to get caught under the middle thread of the socket and binds or cross-threads the bulb and socket, especially if the bulb is inserted slightly skew.

Accordingly, in the present invention, by shortening the third intermediate thread 34 by substantially eliminating the front half of the thread 34, the cross-threading condition cannot exist. The lead thread of the lamp cap will continue to rotate until it is sufficiently straightened out to prevent the cross-threading condition.

As FIG. 1 illustrates, the flared top end 18 includes a top edge 42 and slopes inward to a bottom edge 44 with the first top thread 30 beginning a slight distance "A" from the bottom edge 44. In general, the larger the distance "A" becomes the further the light bulb can be inserted within the socket 10 before the light bulb threads engage the first and second sets of threads 26 and 28 and the less likely a cross-threading condition will occur.

Specifically, as the distance "A" increases, the light bulb is inserted further within the socket 10 before thread engagement begins and a central longitudinal axis of the light bulb approaches a substantially parallel position with respect to a central longitudinal axis of the socket 10. The more parallel these two longitudinal axes become, the less likely a cross-threading condition will exist, especially when the socket 10 includes the first and second sets of threads 26 and 28 of the invention.

Modifications and variations of the present invention are possible in light of the above teachings. It therefore is to be understood that the invention may be practiced otherwise than as specifically described and claimed.

I claim:

1. A socket for receiving a threaded article therein for complementary threaded engagement between said article and said socket, comprising:

a first set of threads disposed within axially spaced, radially extending planes and integrally formed upon a first portion of an interior side wall of said socket wherein the entire circumferential length extent of at least one thread of said first set of threads within its respective one of said axially spaced, radially extending planes is shorter than the circumferential lengths of the other threads of said first set of threads within their respective axially spaced, radially extending planes; and at least one engagement member integrally formed upon a second portion of said interior side wall of said socket for cooperative engagement with said article threads in conjunction with said first set of threads of said socket so that upon engagement of said article within said socket, cross-threading is prevented.

2. The socket as defined in claim 1 wherein said shorter thread is an interior thread of said first set of threads.

3. The socket as defined in claim 1 wherein said engagement member includes at least one protuberance.

4. The socket as defined in claim 1 wherein said at least one engagement member is formed as a second set of threads.

5. The socket as defined in claim 4 wherein said second set of threads include at least one thread formed with a shorter length than the other threads of said second set.

6. The socket as defined in claim 1 wherein said shorter thread is substantially one half the length of said other threads.

7. The socket as defined in claim 1 wherein said shorter thread is positioned with respect to said other threads so that a leading edge of said shorter thread is offset from a leading edge of at least one of said other threads.

8. The socket as set forth in claim 1, wherein:

said threaded article comprises a light bulb; and said socket comprises an upper electrical contact member and a lower electrical contact member for establishing electrical connections with said light bulb.

9. The socket as set forth in claim 1, wherein:

said socket has a substantially cylindrical body portion defined about a longitudinal axis;

said light bulb has a longitudinal axis;

said open end of said socket, through which said light bulb is inserted, is flared outwardly from said substantially cylindrical body portion of said socket so as to facilitate insertion of said light bulb into said socket; and said two sets of threads are disposed a predetermined axial distance inwardly of said substantially cylindrical body portion of said socket and with respect to said flared open end of said socket so as to facilitate coaxial alignment of said light bulb and said socket prior to threaded engagement of said light bulb within said socket so as to further facilitate the prevention of said cross-threading between said light bulb and said socket.

10. A threaded socket for receiving a light bulb therein, said light bulb having a plurality of threads thereon formed about a peripheral portion thereof, comprising:

two sets of threads disposed within axially spaced, radially extending planes and integrally formed upon interior side wall portions of said socket, each one of said sets being disposed upon opposite sides of said socket, each one of said sets of threads including at least three threads which have circumferential lengths which extend about predetermined portions of said interior side wall portions of said socket, each one of said sets of three threads comprising a first top thread positioned proximate an open end of said socket, a second bottom thread positioned proximate a closed end of said socket, and a third thread positioned intermediately between said first and second threads wherein the entire circumferential length extent of said third intermediately disposed thread of each one of said two sets of threads, within its respective one of said axially spaced, radially extending planes, is shorter than the circumferential lengths of both of said first and second threads of said two sets of threads within their respective axially spaced, radially extending planes so that upon threaded engagement of said light bulb within said socket, cross-threading of said threads is prevented.

11. The socket as defined in claim 10 wherein said first and second threads of each set of threads are substantially the same length.

12. The socket as defined in claim 10 wherein a leading edge of said third intermediate thread of each set of threads begins at approximately the midpoint of either one of said first and second threads with respect to the direction of threaded engagement of said threads.

13. The socket as defined in claim 10 wherein the length of said third intermediate thread is substantially one half the length of either of said first and second threads of each set.

14. The socket as set forth in claim 10, wherein:

said socket comprises an upper electrical contact member and a lower electrical contact member for establishing electrical connections with said light bulb.

15. The socket as set forth in claim 1, wherein:

said socket has a substantially cylindrical body portion defined about a longitudinal axis;

said threaded article has a longitudinal axis;

said socket has an open end through which said threaded article is inserted into said socket, said open end of said socket being flared outwardly from said substantially cylindrical body portion of said socket so as to facilitate insertion of said threaded article into said socket; and said first set of threads are disposed a predetermined axial distance inwardly of said substantially cylindrical body portion of said socket and with respect to said flared open end of said socket so as to facilitate coaxial alignment of said threaded article and said socket prior to threaded engagement of said threaded article within said socket so as to further facilitate the prevention of said cross-threading between said threaded article and said socket.

* * * * *